United States Patent [19]

LaPointe et al.

[11] Patent Number: 4,777,112

[45] Date of Patent: Oct. 11, 1988

[54] POLYOXYALKYLENE OVERCOATS FOR IMAGE-RECEIVING ELEMENTS

[75] Inventors: Gary S. LaPointe, Beverly; Richard J. Murphy, Dennis Port, both of Mass.

[73] Assignee: Polaroid Corporation, Cambridge, Mass.

[21] Appl. No.: 72,659

[22] Filed: Jul. 13, 1987

Related U.S. Application Data

[63] Continuation-in-part of Ser. No. 846,587, Mar. 31, 1986, Pat. No. 4,680,247.

[51] Int. Cl.[4] ..... G03C 5/54; G03C 7/00; G03C 1/74

[52] U.S. Cl. ..... 430/213; 430/215; 430/221

[58] Field of Search ..... 430/215, 221, 213

[56] References Cited

U.S. PATENT DOCUMENTS

| | | | |
|---|---|---|---|
| 2,218,255 | 10/1940 | Weyerts et al. | 95/7 |
| 3,325,283 | 6/1967 | Barstow et al. | 430/215 |
| 3,705,798 | 12/1972 | Kleim et al. | 96/3 |
| 3,904,417 | 9/1975 | Kleim et al. | 96/73 |
| 4,294,907 | 10/1981 | Bronstein-Bonte et al. | 430/213 |
| 4,298,674 | 11/1981 | Land et al. | 430/213 |
| 4,367,277 | 1/1983 | Chiklis et al. | 430/213 |
| 4,631,327 | 12/1986 | Mehta | 526/256 |
| 4,680,247 | 7/1987 | Murphy | 430/215 |

*Primary Examiner*—Richard L. Schilling
*Attorney, Agent, or Firm*—Louis G. Xiarhos

[57] ABSTRACT

Diffusion transfer films and processes are disclosed wherein the processing composition includes a light reflecting pigment and an optical filter agent, and the image-receiving layer carries an overcoat comprising a polyoxyalkylene decolorizing agent hydrogen bonded with at least one other polymer and a salt of polyvinyl hydrogen phthalate, the overcoat layer being adapted to decolorize optical filter agent immediately adjacent the interface between the processing composition and the overcoat layer.

8 Claims, 1 Drawing Sheet

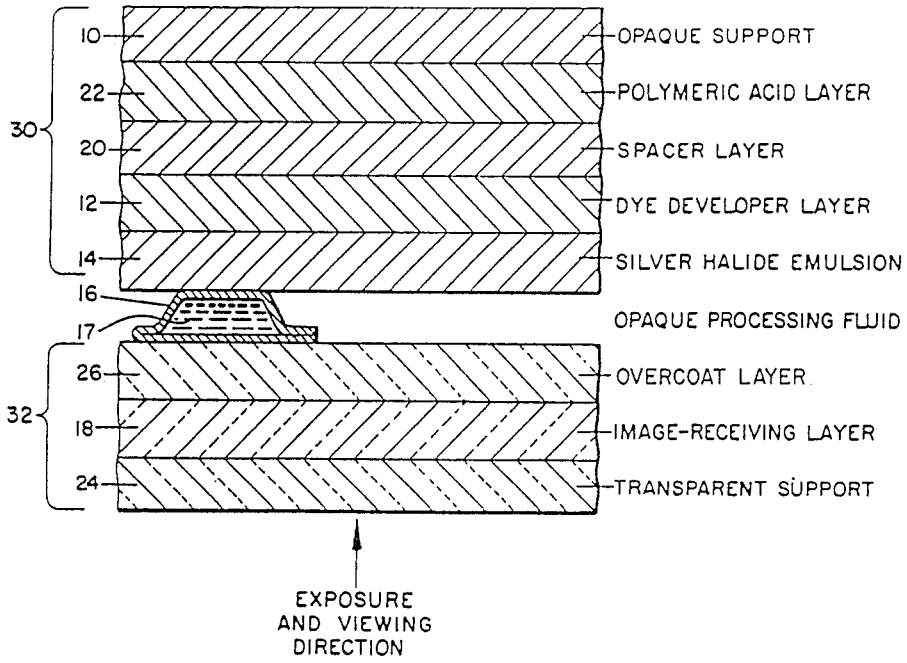
10
22
30
20
12
14
16
17
26
32
18
24
OPAQUE SUPPORT
POLYMERIC ACID LAYER
SPACER LAYER
DYE DEVELOPER LAYER
SILVER HALIDE EMULSION
OPAQUE PROCESSING FLUID
OVERCOAT LAYER
IMAGE-RECEIVING LAYER
TRANSPARENT SUPPORT
EXPOSURE
AND VIEWING
DIRECTION

POLYOXYALKYLENE OVERCOATS FOR IMAGE-RECEIVING ELEMENTS

REFERENCE TO RELATED APPLICATION

This application is a continuation-in-part application of the commonly assigned and copending application of Richard J. Murphy, U.S. Ser. No. 846,587, filed Mar. 31, 1986, now U.S. Pat. No. 4,680,247, and entitled "Photographic Processing Composition With Poly (diacetone acrylamide) oxime And Styrene-Butadiene Latex", the disclosure of which is incorporated herein by reference.

BACKGROUND OF THE INVENTION

This invention is concerned with photography and, more particularly, with image-receiving elements for use in photographic processes which are conducted outside of the camera in which the film is exposed.

U.S. Pat. No. 3,415,644 issued Dec. 10, 1958 to Edwin H. Land discloses photographic products and processes wherein a photosensitive element and an image-receiving element are maintained in fixed relationship prior to exposure, and this relationship is maintained as a laminate after processing and image formation. In these products and processes, the final image is viewed through a transparent (support) element against a reflection i.e., white, background. Photoexposure is made through said transparent element and application of the processing composition provides a layer of light-reflecting material to provide a white background for viewing the final image through said transparent support. The light-reflecting material (referred to in said patent as an "opacifying agent") is preferably titanium dioxide, and it also performs an opacifying function, i.e., it is effective to mask the developed silver halide emulsions so that the transfer image may be viewed without interference therefrom, and it also helps to protect the photoexposed silver halide emulsions from postexposure fogging by light passing through said transparent layer if the photoexposed film unit is removed from the camera before image-formation is completed.

U.S. Pat. No. 3,647,437, issued Mar. 7, 1972 to Edwin H. Land, discloses photographic products which may be processed outside of the camera in which the film is exposed, fogging of the film by ambient light being prevented by provision of one or more opacifying dyes, sometimes, referred to as light-absorbing optical filter agents, appropriately positioned in the film unit after photoexposure. In a particularly useful embodiment of that invention, the film unit is a film unit of the type described in the aforementioned U.S. Pat. No. 3,415,644 and comprises first and second sheet-like elements, the first sheet-like element comprising an opaque base carrying a silver halide emulsion, and the second sheet-like element comprising a transparent support carrying an image layer, i.e., a layer adapted to receive an image-wise distribution of an image-forming material initially present in said first sheet-like element. After photoexposure a processing composition, adapted to develop the exposed silver halide emulsion and to form the desired image in said image layer, is distributed in a thin layer between said sheet-like elements. The processing composition contains a light-reflecting pigment, such as titanium dioxide, and at least one light-absorbing optical filter agent, such as a pH-sensitive phthalein dye which is colored at the initial pH of said processing composition. As disclosed in said U.S. Pat. No. 3,647,437, the concentrations of said light-reflecting pigment and said optical filter agent(s) are such that the layer of processing composition is sufficiently opaque to light actinic to the silver halide emulsion that the film unit may be ejected from the camera immediately after the processing composition is distributed, notwithstanding the fact that the second sheet-like element will transmit light incident on the surface thereof. This opacification system is quite effective and is employed in Polaroid Land SX-70 film. The light-absorbing capacity of the optical filter agent is discharged after this ability is no longer needed, so that the optical filter agent need not be removed from the film unit. Where the optical filter agent is a pH-sensitive dye, such as phthalein indicator dye, it may be discharged or decolorized by reducing the pH after a predetermined time, e.g., by making available an acid-reacting material such as a polymeric acid.

In the preferred embodiments of the opacification system described in U.S. Pat. No. 3,647,437, the concentrations of the light-reflecting pigment and light-absorbing optical filter agent in the layer of processing composition will be such that that layer will have a transmission density of at least about 6 but a reflection density not greater than about 1. The presence of a long chain substituent, e.g., a long chain alkoxy group, on the optical filter agent is useful in reducing its diffusibility so that diffusion to the image-receiving layer is minimized.

A reflection density of about 1 will be recognized as very small compared with a transmission density of 6 or more for the same layer. In practice it has been possible to use a concentration of optical filter agents and titanium dioxide such that the reflection density of the processing composition layer, as measured about 30 seconds after distribution, is much lower than 1, e.g., about 0.5 t 0.6. While transferring dye and the emerging dye image may be seen at opacification system reflection densities of about 0.5, the presence of such temporary coloration of the highlight or white areas of the image, and the temporary distortion of the colors of the already transferring image dyes, is aesthetically undesirable.

As noted above, where the optical filter agent is a pH-sensitive dye, it is "discharged", i.e., rendered substantially colorless, by a reduction of the pH of the strata containing the optical filter agent. These strata include the light-reflecting pigment layer, provided by the processing composition, as well as the image-receiving layer and any other layers between the light-reflecting pigment layer and the transparent support through which the final image is viewed. This pH reduction is effected, to a pH level below the pKa of the optical filter agent, after a predetermined time. This delay is necessary in order that silver halide development be substantially completed before incident light is transmitted to the developing silver halide emulsions. Since the image dyes are preferably soluble and diffusible at the initial pH of the process but substantially nondiffusible at a lower pH, reduction of the pH to the appropriate lower pH after a predetermined period serves the very important function of controlling unwanted continued transfer of image dyes after the desired dye image has been formed.

It will be recognized that these desired results of pH reduction are only partly compatible, for early pH reduction to provide a white background early in the process could prematurely stop transfer of image dyes, resulting in a pale, i.e., low density, image which may also have an unbalanced color balance.

In U.S. Pat. No. 4,298,674 (issued Nov. 3, 1981 to E. H. Land, L. D. Cerankowski and N. Mattucci) and in U.S. Pat. No. 4,294,907 (issued Oct. 13, 1981 to I. Y. Bronstein-Bonte, E. P. Lindholm and L. D. Taylor), there is disclosed and claimed, diffusion transfer products and processes of the foregoing type where the background appears substantially white to the viewer, substantially immediately after the processing composition is applied while retaining opacification. As disclosed in said patents, it has been found that it is possible to significantly reduce the reflection density provided by the layer of processing composition containing the light-reflecting pigment and the optical filter agent without significantly reducing the transmission density thereof. This highly desirable improvement is obtained by decolorizing, substantially immediately after application of the processing composition, the optical filter agent immediately adjacent the interface between the processing composition and the layer of the second sheet-like element in contact with the processing composition. It is only necessary to decolorize a very small fraction of the applied optical filter agent in order to effectively render the interface substantially "white" when viewed by reflection. Since the reflection density is the result of light being absorbed twice by a given quantity of dye—once when the light enters and a second time when it is reflected back—it will be seen that decolorization of even a few molecules of dye adjacent the interface provides an effect which is so amplified by the optics of reflection that one can substantially lower the reflection density and increase the apparent whiteness of the layer of the processing composition providing the background against which the image is viewed without reducing the transmission density of the "white" layer to any significant extent.

The "decolorizing" layer is provided between the image-receiving layer and the layer of processing composition. This decolorizing layer comprises a substantially nondiffusible agent adapted to decolorize the small concentration of optical filter agent which is present immediately adjacent the interface between the processing composition and the decolorizing layer. This decolorizing is essentially limited to the optical filter agent which is present immediately adjacent the interface between the decolorizing layer and the processing composition. Even though the decolorizing layer is relatively thin, it inhibits diffusion of optical filter agent into the image-receiving layer where it may react with the mordant to form a new species whose color is discharged only at a lower pH; e.g., the new species exhibits a much lower pKa and remains colored until the pH is reduced to a much lower level than otherwise would be required for decolorization. The remaining optical filter agent is discharged or decolorized by a subsequent pH reduction.

In the preferred embodiments of said U.S. Pat. Nos. 4,298,674 and 4,294,907, the decolorizing agent is a polyoxyalkylene polymer and the optical filter agent is a pH-sensitive phthalein dye.

In U.S. Pat. No. 4,367,277 (issued Jan. 4, 1983 to C. K. Chiklis and N. C. Mattucci), there is disclosed and claimed an image-receiving element for diffusion transfer photographic films and processes wherein a layer of unhardened gelatin is coated over the image-receiving layer. The unhardened gelatin layer is adapted to decolorize optical filter agent in the manner aforedescribed, i.e., immediately adjacent the interface between the processing composition and the decolorizing layer.

In the production of image-receiving elements for use in diffusion transfer photographic processing of the aforedescribed type, the provision of a polymeric overcoat on an image-receiving layer oftentimes results in a reduction in the optical clarity of the image-receiving element including such layers. It will be appreciated that the optical clarity of an image-receiving element will be of particular importance where a photosensitive element is photoexposed through the image-receiving element. Inasmuch as image-forming materials, e.g., image-providing dyes, will be diffused through an overcoat layer for mordanting in the image-receiving layer, the inclusion in the overcoat layer of additives or other agents adapted to alleviate haze or other objectionable properties may, in turn, have a detrimental influence on the rate or quality of image formation. In the aforementioned U.S. Pat. No. 4,294,907, there is described the use of a decolorizing overcoat layer comprising a polyether, i.e., a polyoxyalkylene polymer, hydrogen bonded in a complex with another polymer. The overcoat layer provides desired decolorizing effects and is described as sufficiently "hard" to resist rub off and blocking. In an overcoat of the type therein described, the development of haze in the overcoat layer may be observed. It will be appreciated that the provision of such an overcoat layer, having improved clarity and permitting diffusion transfer processing without a loss in photographic performance, will be of particular interest.

SUMMARY OF THE INVENTION

It has been found that an image-receiving element having as an overcoat layer, a polyoxyalkylene decolorizing agent hydrogen bonded with at least one other polymer, can be improved in clarity and photographic performance by including therein polyvinyl hydrogen phthalate (PVHP). The inclusion of PVHP in the overcoat layer provides a reduction in the level of haze frequently observed in the case of an image-receiving element having an overcoat of the aforedescribed type and provides improved clearing efficiency without a loss in photographic sensitometry. In addition, the PVHP addition shows desirable compatibility with polymeric mordanting compounds of the quaternary type typically employed in the production of image-receiving elements, with the result that the image-receiving and overcoat layers can be conveniently coated simultaneously onto a suitable substrate material, thus, affording a processing advantage and providing an important method aspect of the present invention.

BRIEF DESCRIPTION OF THE DRAWING

The Figure illustrates in diagrammatic cross-section a film unit embodying the present invention and comprising a photosenstive element 30, an image-receiving element 32, and a rupturable container or pod 16 releasably holding a processing composition 17.

DETAILED DESCRIPTION OF THE INVENTION

As indicated above, this invention is primarily directed to image-receiving elements for use in photographic processes wherein the desired image is obtained by processing an exposed photosensitive silver halide material, with a processing composition distributed between two sheet-like elements, one of said elements including said photosensitive material. The processing composition is so applied and confined within and between the two sheet-like elements as not to contact or wet outer surfaces of the superposed elements, thus providing a film unit or film packet whose external surfaces are dry. The processing composition is viscous and preferably is distributed from a single-use rupturable container; such pressure rupturable processing containers are frequently referred to as "pods". The final image may be black-and-white, monochrome or multicolor and either negative or positive with respect to the photographed subject. The present invention is especially, if not uniquely, adapted for facilitating processing outside of a camera film units which are maintained as an integral laminate after processing, the desired image being viewed through one face of said laminate.

In diffusion transfer embodiments of this invention the diffusible image-providing substance may be a complete dye or a dye intermediate, e.g., a color coupler. The preferred embodiments of this invention use a dye developer, that is, a compound which is both a silver halide developing agent and a dye disclosed in U.S. Pat. No. 2,983,606, issued May 9, 1961 to Howard G. Rogers. As is now well known, the dye developer is immobilized or precipitated in developed areas as a consequence of the development of the latent image. In unexposed and partially exposed areas of the emulsion, the dye developer is unreacted and diffusible and this provides an imagewise distribution of unoxidized dye developer, diffusible in the processing composition, as a function of the point-to-point degree of exposure of the silver halide emulsion. At least part of this imagewise distribution of unoxidized dye developer is transferred, by imbibition, to a superposed image-receiving layer to provide a reversed or positive color image of the developed image.

The image-receiving layer preferably contains a mordant for transferred unoxidized dye developer. Suitable materials for use as image-receiving layers are known and are described, for example, in U.S. Pat. Nos. 3,148,061 (issued Sept. 8, 1964 to H. C. Haas); 3,770,439 (issued Nov. 6, 1973 to L. D. Taylor); and 4,080,346 (issued Mar. 31, 1978 to S. F. Bedell). A preferred class of materials useful for this purpose includes the polymeric mordants having quaternary ammonium mordanting moieties.

Dye developers, as noted above, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group.

Multicolor images may be obtained using the color image-forming components, for example, dye developers, in an integral multi-layer photosensitive element, such as is disclosed in the aforementioned U.S. patents and in U.S. Pat. No. 3,345,163 issued Oct. 3, 1967 to Edwin H. Land and Howard G. Rogers. A suitable arrangement of this type comprises a support carrying a red-sensitive silver halide emulsion stratum, a green-sensitive halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion stratum, for example in the form of particles, or it may be disposed in a stratum (e.g., of gelatin) behind the appropriate silver halide emulsion stratum. Each set of silver halide emulsion and associated dye developer strata preferably are separated from other sets by suitable interlayers. In certain instances, it may be desirable to incorporate a yellow filter in front of the green-sensitive emulsion and such yellow filter may be incorporated in an interlayer. However, if the yellow dye developer has the appropriate spectral characteristics and is present in a state capable of functioning as a yellow filter, a separate yellow filter may be omitted.

For convenience, further description of this invention will be in the context of the use of dye developers and positive transfer images.

The Figure illustrates in diagrammatic cross-section a film unit embodying the present invention and comprising a photosensitive element 30, an image-receiving element 32, and a rupturable container or pod 16 releasably holding a processing composition 17. For ease of understanding, the photosensitive element is shown as one containing a single silver halide emulsion and a single dye developer, the film unit thus providing a monochrome image.

Photosensitive element 30 is shown in superposed relationship with an image-receiving element 32, with a rupturable container 16 (holding an opaque processing composition 17) so positioned as to discharge its contents between said elements upon suitable application of pressure, as by passing through a pair of pressure applying rolls or other pressure applying means (not shown). Photosensitive element 30 comprises an opaque support 10 carrying a polymeric acid layer 22, a spacer layer 20, and a layer 12 of a dye developer over which has been coated a silver halide emulsion layer 14. The image-receiving element 32 comprises a transparent support 24 carrying, in turn, an image-receiving layer 18 and an overcoat layer 26 comprising a polyoxyalkylene decolorizing agent hydrogen bonded with at least one other polymer and polyvinyl hydrogen phthalate (PVHP).

Photoexposure of the silver halide emulsion layer is effected through the transparent support 24 and the layers carried thereon, i.e., image-receiving layer 18 and overcoat layer 26, which layers are also transparent, the film unit being so positioned within the camera that light admitted through the camera exposure or lens system is incident upon the outer or exposure surface of the transparent support 24. After exposure, the film unit is advanced between suitable pressure-applying members, rupturing the container 16, thereby releasing and distributing a layer of the opaque processing composition and thereby forming a laminate of the photosensitive element 30 and the image-receiving element 32 with their respective support members providing the outer layers of the laminate. The opaque processing composition contains a film-forming polymer, a white pigment and has an initial pH at which one or more optical filter agents contained therein are colored; the optical filter agent (agents) is (are) selected to exhibit the appropriate light absorption, i.e., optical density, over the wavelength range of light actinic to the particular silver halide emulsion(s). As a result, ambient or environmental light within the wavelength range incident upon the surface of transparent support surface and transmitted transversely through said transparent support and the transparent layers carried thereon in the direction of the exposed silver halide emulsion 14 is absorbed thereby avoiding further exposure of the photoexposed and developing silver halide emulsion 14. In exposed and developed areas, the dye developer is oxidized as a function of the silver halide development and immobilized. Unoxidized dye developer associated with undeveloped and partially developed areas remains mobile and in transferred imagewise to the image-receiving layer 18 to provide the desired positive image therein.

Permeation of the alkaline processing composition through the spacer layer 20 to the polymeric acid layer 22 is so controlled that the process pH is maintained at a high enough level to effect the requisite development and image transfer and to retain the optical filter agent (agents) in colored form within the processing composition layer and on the silver halide emulsion side of said layer, after which pH reduction effected as a result of alkali permeation into the polymeric acid layer 22 is effective to reduce the pH to a level which changes the optical filter agent to a colorless form. Absorption of the water from the applied layer of the processing composition results in a solidified film composed of the film-forming polymer and the white pigment dispersed therein, thus providing a light-reflecting layer which also serves to laminate together the photosensitive component 30 and the image-receiving component 32 to provide the final integral image. The positive transfer image in dye developer present in the image-receiving layer 18 is viewed through the transparent support 24 against the light-reflecting layer which provides an essentially white background for the dye image and also effectively masks from view the developed silver halide emulsion 14 and dye developer immobilized therein or remaining in the dye developer layer 12.

The optical filter agent is retained within the final film unit laminated and is preferably colorless in its final form, i.e., exhibiting no visible absorption to degrade the transfer image or the white background therefor provided by the reflecting layer. The optical filter agent may be retained in the reflecting layer under these conditions, and it may contain a suitable "anchor" or "ballast" group to prevent its diffusion into adjacent layers. Some of the optical filter agent may diffuse into the photosensitive component and be mordanted by the gelatin or other material present on the silver halide emulsion side of the reflecting layer; optical filter mordanted in the photosensitive component 30 may be colorless or colored in its final state so long as any color exhibited by it is effectively masked by the reflecting layer. In the preferred embodiment, the photosensitive element contains hardened gelatin and the optical filter agent(s) is a pH-sensitive phthalein dye.

In the illustrated embodiment, photoexposure is effected through the image-receiving element. While this is a particularly useful and preferred embodiment, especially where the photosensitive element and the image-receiving element are secured together as shown in U.S. Pat. Nos. 3,415,644 and 3,647,437, it will be understood that the image-receiving element may be initially positioned out of the exposure path and superposed upon the photosensitive element after photoexposure.

A light-absorbing material optical filter agent, preferably a pH-sensitive dye such as an indicator dye, is provided so positioned and/or constituted as not to interfere with photoexposure but so positioned between the photoexposed silver halide emulsions and the transparent support during processing after photoexposure as to absorb light which otherwise might fog the photoexposed emulsions. Furthermore, the light-absorbing material is so positioned and or constituted after processing as not to interfere with viewing the desired image shortly after said image has been formed. In the preferred embodiments, the optical filter agent is initially contained in the processing composition in colored form together with a light-reflecting material, e.g., titanium dioxide.

The concentration of indicator dye is selected to provide the optical transmission density required, in combination with other layers intermediate the silver halide emulsion layer(s) and the incident radiation, to prevent nonimagewise exposure, i.e., fogging, by incident actinic light during the performance of the particular photographic process. The transmission density and the indicator dye concentration necessary to provide the requisite protection from incident light may be readily determined for any photographic process by routine experimentation, as a function of film speed or sensitivity, processing time, anticipated incident light intensity, etc., as described in said U.S. Pat. No. 3,647,437. It will be recognized that a particular transmission density may not be required for all portions of the spectrum, lesser density being sufficient in wavelength regions corresponding to lesser sensitives of the particular photosensitive material.

In a particularly useful embodiment, the light-absorbing dye is highly colored at the pH of the processing composition, e.g., 13–14, but is substantially non-absorbing of visible light at a lower pH, e.g., less than 10–12. Particularly suitable are phthalein dyes having a pKa of about 13 to 13.5; many such dyes are described in the aforementioned U.S. Pat. No. 3,647,437. This pH reduction may be effected by an acid-reacting reagent appropriately positioned in the film unit, e.g., in a layer of the photosensitive element as shown in the Figure or in a layer between the transparent support and the image-receiving layer.

The presence of a long chain substituent on the optical filter agent, e.g., phthalein dye, is preferred since this minimizes diffusion of the optical filter agent from the processing composition layer. In the preferred embodiments at least one of the phthalein dyes contains the grouping

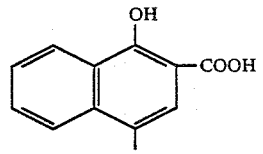

It will be understood that a mixture of light-absorbing materials may be used so as to obtain absorption in all critical areas of the visible and near-visible by which the silver halide emulsions, e.g., a panchromatic black-and-white silver halide emulsion or a multicolor silver halide photosensitive element, being used are exposable. Many dyes which change from colored to colorless as a function of pH reduction, e.g., phthalein dyes, are known and appropriate selection may be made by one skilled in the art to meet the particular conditions of a given process and film unit; such dyes are frequently referred to in the chemical and related arts as indicator dyes.

As indicated previously, overcoat layer 26 of image-receiving element 32 comprises a polyoxyalkylene polymer, coated with another polymer which can form a hydrogen bond complex with the polyether, and polyvinyl hydrogen phthalate (PVHP). Such an overcoat provides good decolorizing properties, permits the production of an image-receiving element having good clarity, and can be conveniently applied on a previously coated image-receiving layer 18 or can be simultaneously coated with layer 18 onto a suitable transparent support material 24.

The polyether should be substantially non-diffusible from overcoat layer 26 into the processing composition, thereby avoiding premature discharge of the optical filter agent in the processing composition layer. This factor may be controlled by selecting a higher molecular weight polyether or by selecting a polyether having a sufficient hydrocarbon group to reduce its diffusibility. The polyether should not be a liquid at room temperature. The preferred polyethers are waxes at room temperature.

The ability of a given polyether to decolorize the particular optical filter agent(s) may be readily determined by a procedure such as the following: the optical filter agent in question is dissolved in 1.5 molar aqueous potassium hydroxide to provide a solution of about 0.01 weight percent of the optical filter agent in a test tube. The test decolorizing agent is added to the test tube in small increments. Decolorizing agents which decolorize or substantially reduce the visible absorption of the optical filter agent when added to the potassium hydroxide in quantities less than about 35 times (by weight) the optical filter agent concentration in said solution are preferred as they avoid the need to use undesirably high decolorizing layer coverages, e.g., such thickness as might undesirably slow down or reduce the transfer of image dye.

As examples of polyethers useful in overcoat 26, mention may be made of the polyoxyethylene polyoxypropylene block copolymer commercially available under the tradename "Pluronic F-127" from BASF Wyandotte Corp. (average molecular weight about 12,500) and the nonylphenyl terminated polyoxyethylene

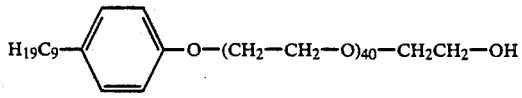

sold under the tradename "Igepal CO-890" by GAF. A preferred nonylphenoxyethylene oxide ethanol is sold under the tradename "Igepal CO-997".

As noted in the aforementioned U.S. Pat. No. 4,298,674, Pluronic F-127 has been found effective with a number of phthalein dyes. Igepal CO-890 has been found to be at least as effective as Pluronic F-127, and to be more effective in decolorizing phthalein dyes such as:

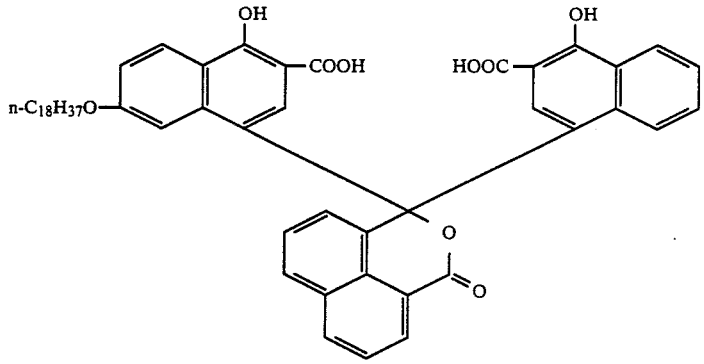

The mechanism by which the polyether provides decolorization effects is not based upon a pH change. It has been determined that the addition of either Igepal CO-890 or Pluronic F-127 did not change the pH. It appears that the presence of a long chain substituent on the phthalein dye markedly reduces the quantity of the polyether required to effect the decolorization. It is believed that the polyether forms a complex with the phthalein dye which complex exhibits an apparent pKa higher than said phthalein dye in the alkaline processing composition. It also appears that phthalein dyes containing the grouping

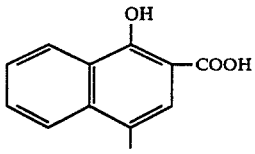

are more readily decolorized by the polyether.

As noted above, use of a polyoxyethylene polyoxypropylene block copolymer has been found to be useful in the practice of this invention. Such block copolymers may be represented by the formula $$HO-(CH_2CH_2-O-)_a(\underset{\underset{CH_3}{|}}{CH}-CH_2-O-)_b(CH_2CH_2O-)_cH$$

Varying the ratios a, b and c will vary the hydrophobic-hydrophilic balance of the block copolymer and such varying may be of value in the practice of this invention. Other polyoxyalkylene polymers, such as high molecular weight polyethylene glycol (m.wt. 6000) commercially available under the tradename Carbowax 6000 also may be used, although the above block copolymers are more effective.

A particularly effective polymer for hydrogen bonding a polyether decolorizing agent is a copolymer of diacetone acrylamide and methacrylic acid, preferably a 1:1 monomer ratio. Hydrogen bonding—a non-valent bonding—is believed to occur between the —COOH groups provided by the methacrylic acid and the oxygen of the ether group ($—CH_2—CH_2—O—CH_2—CH_2—$). The diacetone acrylamide provides a hydrophobic property, and the ratio of the two monomers may be adjusted to provide the balance of hydrophilic and hydrophobic properties desired for a given photographic system. 1:1 copolymers of methacrylic acid and diacetone acrylamide having a molecular weight of about 10,000 to 20,000 have been found to be particularly useful. The polymeric polyether preferably has a molecular weight of at least about 2000; the molecular weight in combination with the hydrophillic/hydrophobic properties of the polymeric polyether should be such as to render it substantially nondiffusible from overcoat layer.

Where the ether groups do not hydrogen bond with sufficient —COOH groups to give the desired "hardness", e.g., because the molecular geometry does not provide the appropriate "fit", another hydrogen bonding polymer, e.g., polyvinyl pyrrolidone, may be incorporated. Hydrogen bonding also may occur between the carboxyl group and the amide groups. The particular hydrogen bonding group is not important, and suitable materials may be readily selected by routine experimentation. The hydrogen bonded complex should precipitate in water. The hydrogen bond is reversible in aqueous alkaline solution, thus making the polyether decolorizing agent available to complex with the phthalein optical filter agent and to permit rapid diffusion of the image dye(s) through the decolorizing to the image-receiving layer.

As noted above, methacrylic acid is a preferred monomer in the hydrogen bonding polymer. Acrylic acid also may be used but is a less effective hydrogen bonding agent, possibly because fewer carboxyl groups are properly positioned to hydrogen bond with the polyether. The pendant methyl groups of the methacrylic acid moieties are believed to limit the ability of the carboxyl group to rotate around the polymer backbone, so that more of the carboxyl groups are properly positioned. An especially preferred hydrogen bonding polymer is a tetrapolymer, in a weight ration of 1/1/0.1/0.1, respectively, of methacrylic acid, diacetone acrylamide, butylacrylate and styrene. Such a copolymer will typically be incorporated into a coating formulation for the production of overcoat layer 26 in the form of an ammonium salt. The free acid is regenerated during drying of layer 26 with volatilization of ammonia.

The polyvinyl hydrogen phthalate (PVHP) component of overcoat layer 26 is a water soluble anionic polymeric material which is employed as a salt. Typically, the PVHP component will be used as a potassium salt, although other salts such as lithium, sodium, and preferably ammonium salts can be employed. These polymeric anionic salts are known and described, for example in U.S. Pat. No. 3,705,798 (issued Dec. 12, 1972 to P. O. Kliem, et al) and in U.S. Pat. No. 3,904,417 (issued Sept. 9, 1975 to P. O. Kliem, et al.).

A preferred overcoat layer 26 is a layer comprising one part of a 1/1/0.35 mixture of Igepal CO-997 (nonylphenoxyethylene oxide ethanol), 1.0/1.0/0.1/0.1 tetrapolymer of methacrylic acid/diacetone acrylamide/-butyl acrylate/styrene and polyvinylpyrrolidone, and one part potassium salt of polyvinyl hydrogen phthalate. Such a layer can be formed by coating an aqueous solution of the components (having, for example, a solids content of from 2 to 4% by weight), using known coating methods, and drying to the desired overcoat layer. Aqueous alcohol solvents can be used for this purpose. If desired, an overcoat layer 26 can be coated over a previously coated and dried image-receiving layer 18. Image-receiving layer 18 and overcoat layer 26 can, however, be simultaneously coated onto a suitable transparent support material 24.

The amount of PVHP component in overcoat layer 26 can vary with the particular nature of the photographic system employed and the coverage of the layer. In general, the PVHP component will be employed in an amount sufficient to improve the clearing efficiency and optical clarity of the image-receiving element. For example, amounts in the range of from 10% to 50% can be used with good results. It is particularly notable that improved clearing efficiency can be obtained without loss in sensitometric performance.

The coverage of overcoat layer 26 can vary depending upon the particular photograhic system and especially on the nature and concentration of the indicator dyes and components of the overcoat layer. Suitable coverages can be determined by routine experimentation. Good results can be achieved using a coverage in the range of from 530 to 2370 mg/m$^2$, a coverage of from 860 to 1620 being preferred.

The mechanisms by which the incorporation of a PVHP salt component in an overcoat layer provides more efficient opacification dye clearing and improved clarity are not completely understood. While applicants do not wish to be bound by any particular theory or mechanism in explication thereof, it is believed that such improvements are the result, at least in part, of an interaction between the PVHP component of the overcoat layer and quaternary mordanting sites in the image-receiving layer. This interaction is believed to result, on coating of overcoat layer 26 over image-receiving layer 18, in the formation of a viscous layer at the interface of the respective layers. The viscous interlayer is believed to serve as a barrier to interactions between the image-receiving layer and other polymeric components of the overcoat layer (e.g., polyether decolorizing agent and hydrogen bonding polymers) which interactions are believed to promote loss in opacification dye clearing efficiency, precipitation and resulting haze formation. The preferential interaction of the PVHP component with the image-receiving layer components, thus, serves a useful function in minimizing the occurrence of other, deleterious, interactions. The preferential interaction and formation of a viscous barrier layer is believed to be more readily accomplished when the image-receiving and overcoat layers are deposited simultaneously.

The following examples which are intended to be illustrative and not limitative are included to provide a better understanding of the present invention. All parts and percentages are by weight unless otherwise indicated.

EXAMPLE 1

A photographic film unit adapted to the provision of a permanent photographic laminate was prepared in the following manner. A multicolor photosensitive element was prepared by coating the following layers, in succession, onto an opaque subcoated polyethylene terephthalate film base of approximately 0.127 mm thickness.

1. a polymeric acid layer comprising about 24,795 mgs/m$^2$ of the half butyl ester of ethylene maleic anhydride, about 4375 mgs/m$^2$ of polyvinyl butyral and about 99 mgs/m$^2$ of titanium dioxide;

2. a layer of styrene maleic anhydride (including about 2% ethyl acetate) coated at a coverage of about 350 mgs/m$^2$;

3. a timing layer comprising a 40/40/18/2 tetrapolymer of butyl acrylate/diacetone acrylamide/carbomethoxymethyl acrylate/acrylic acid coated at a coverage of about 2500 mgs/m$^2$;

4. a cyan dye developer layer comprising about 612 mgs/m$^2$ of the cyan dye developer represented by the formula

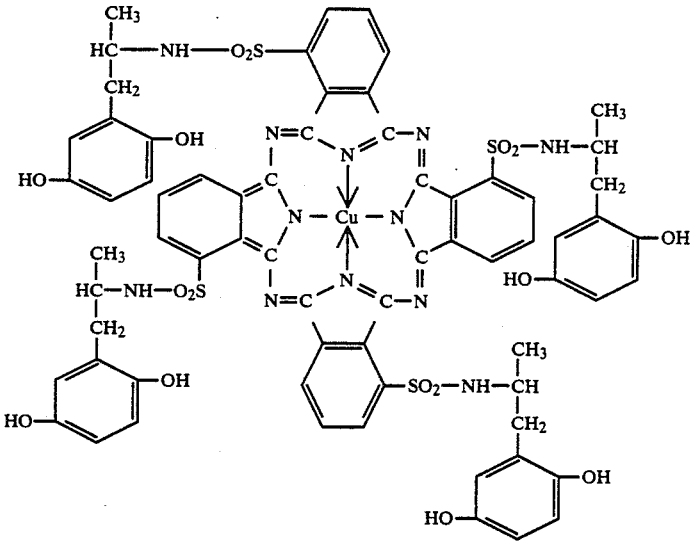

about 367 mgs/m$^2$ of gelatin, about 61 mgs/m$^2$ of 4'-methylphenyl hydroquinone (MPHQ), and about 120 mgs/m$^2$ of 1,3-bis[1-(4-hydroxyphenyl)-tetrazolyl-(5)-mercapto]-2-propanone oxime;

5. a layer comprising about 1000 mgs/m$^2$ of titanium dioxide, about 375 mgs/m$^2$ of a 61/29/6/4/0.4 pentapolymer of butylacrylate/diacetone acrylamide/methylacrylic acid/styrene/acrylic acid, about 125 mgs/m$^2$ of gelatin, about 375 mgs/m$^2$ of polymethylmethacrylate and about 100 mgs/m$^2$ of polyacrylamide;

6. a red-sensitive silver iodobromide layer comprising about 967 mgs/m$^2$ of silver (1.5 microns), about 242 mgs/m$^2$ of silver (1.1 microns), about 786 mgs/m$^2$ of gelatin and 61 mgs/m$^2$ of MPHQ;

7. an interlayer comprising about 3420 mgs/m$^2$ of the pentapolymer described in layer 5, about 180 mgs/m$^2$ of polyacrylamide, and about 132 mgs/m$^2$ of monomethylol dimethyl hydantoin;

8. a magenta dye developer layer comprising about 420 mgs/m$^2$ of the magenta dye developer represented by the formula

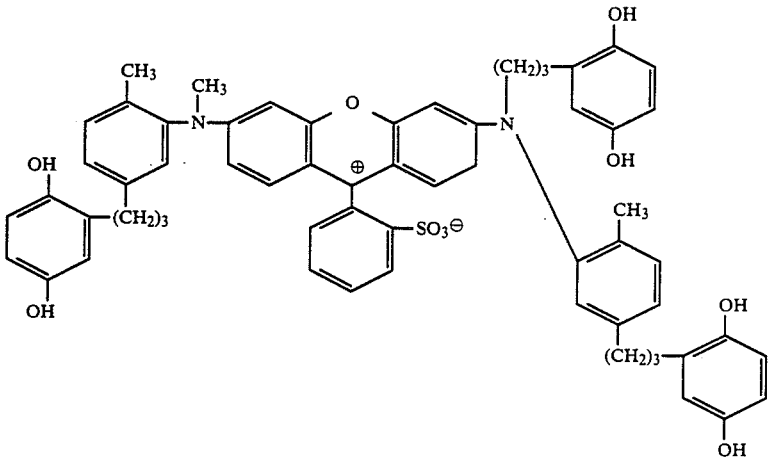

and about 286 mgs/m$^2$ of gelatin, and about 500 mgs/m$^2$ of 2-phenylbenzimidazole;

9. a layer comprising about 400 mgs/m$^2$ of Dow 620 (carboxylated sytrene-butadiene copolymer) latex, about 133 mgs/m$^2$ of gelatin, and about 160 mgs/m$^2$ of MPHQ;

10. a green sensitive silver halide emulsion layer comprising about 750 mgs/m$^2$ of silver 1.8 microns), about 614 mgs/m$^2$ of silver (1.1 microns), about MPHG, 730 mgs/m$^2$ of gelatin and about 100 mgs/m$^2$ of 11. an interlayer comprising about 2460 mgs/m$^2$ of the pentapolymer described in layer 5, about 130 mgs/m$^2$ of polyacrylamide, about 700 mgs/m$^2$ scavenger represented by the formula

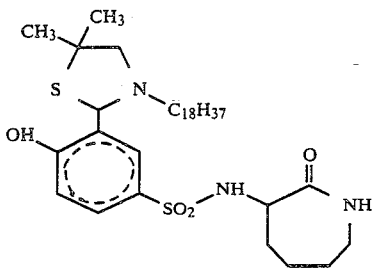

and 17 mgs/m$^2$ of succindialdehyde;

12. a layer comprising about 550 mgs/m$^2$ of benzidine yellow dye and about 275 mgs/m$^2$ of gelatin;

13. a yellow image dye-providing layer comprising about 1210 mgs/m$^2$ of a yellow image dye-providing material represented by the formula

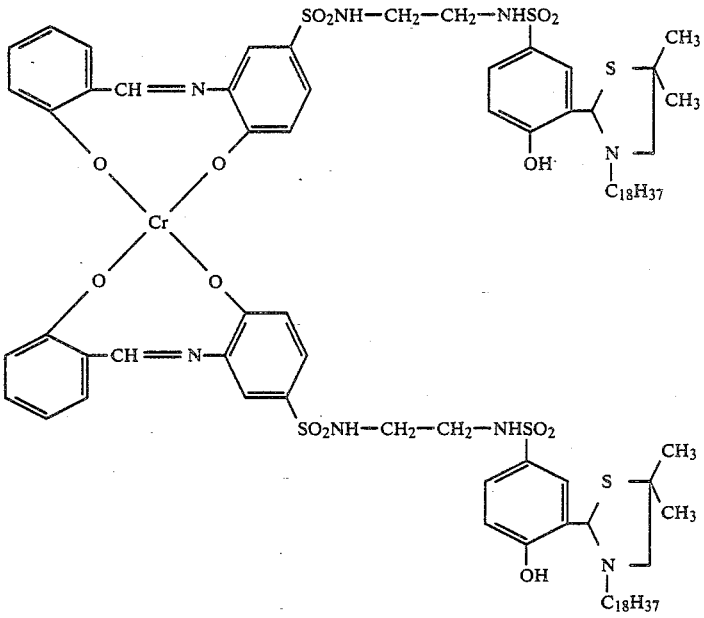

about 411 mgs/m$^2$ of gelatin; and about 200 mgs/m$^2$ of Dow 620 latex;

14. a layer comprising about 490 mgs/m$^2$ of phenyl tertiarybutyl hydroquinone and about 245 mgs/m$^2$ of gelatin;

15. a blue-sensitive silver iodobromide layer comprising about 174 mgs/m$^2$ of silver (1.6 microns), about 116 mgs/m$^2$ of silver (1.25 microns) and about 145 mgs/m$^2$ of gelatin; and 16. a gelatin layer coated at a coverage of about 800 mgs/m$^2$.

The image-receiving element comprised a 0.064 mm thick transparent subcoated polyester film base, upon which there were coated in succession:

1. an image-receiving layer coated at a coverage of about 300 mgs/ft$^2$ (3229 mgs/m$^2$) of a graft copolymer comprised of 4-vinylpyridine (4VP) and vinyl benzyl trimethylammonium chloride (TMQ) grafted onto hydroxyethyl cellulose (HEC) at ratios of HEC/4VP/TMQ of 2.2/2.2/1 and about 4 mgs/ft$^2$ (43 mgs/m$^2$) of 1,4-butanediol-diglycidyl ether; and 2. an overcoat layer coated at a coverage of about 120 mgs/ft$^2$ (1292 mgs/m$^2$) comprising 1 part of polyvinyl hydrogen phthalate, potassium salt and 1 part of a 1/1/0.35 mixture of Igepal CO-997 (nonylphenoxyethylene oxide ethanol), a 1/1/0.1/0.1 tetrapolymer of diacetone acrylamide/methacrylic acid/butyl acrylate/styrene, and 0.35 part of polyvinylpyrrolidone.

The film unit was processed with a processing composition made up as follows:

| INGREDIENTS | WEIGHT PERCENT |
|---|---|
| Water | 40.75 |
| Titanium dioxide | 48.44 |
| Colloidal silica (30% aqueous dispersion) | 0.23 |
| Potassium hydroxide (50% aqueous solution) | 5.62 |
| N—phenethyl-α-picolinium bromide (50% solids) | 1.46 |
| 6-methyluracil | 0.59 |
| Oximated polydiacetone acrylamide | 0.67 |
| Hypoxanthine | 0.57 |
| 2-methylamidazole | 0.49 |
| Zonyl FSN (40% solids) | 0.20 |
| 1-(4-hydroxyphenyl)-1H—tetrazole-5-thiol | 0.019 |

-continued

| INGREDIENTS | WEIGHT PERCENT |
|---|---|
| 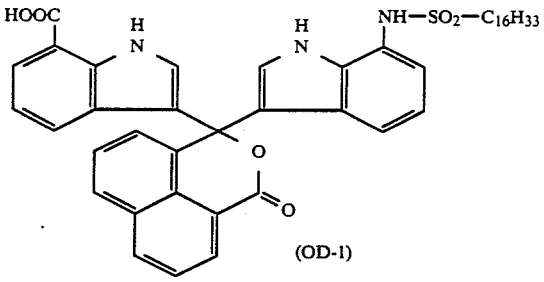 (OD-1) | 0.44 |
| 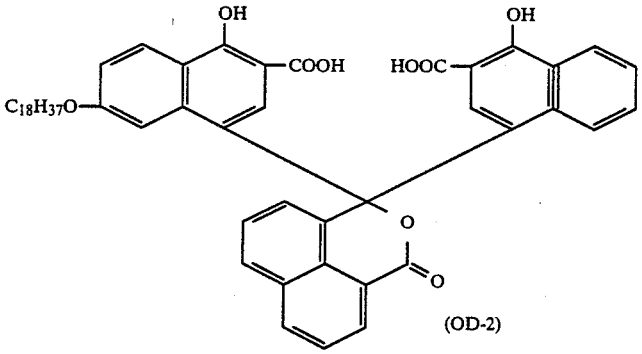 (OD-2) | 1.50 |

The film unit (referred to as Film Unit-A) was exposed (0.5 meter-candle-second) through the transparent base of the image-receiving element on a sensitometer to a test exposure scale with white light and processed by passing the film unit through a pair of rollers at a gap spacing of aobut 0.0024 inch. Identical film units were processed at 55° F., 75° F., 95° F., 105° F. and 115° F. The neutral density columns of the images were read on a densitometer to obtain the $D_{max}$ and $D_{min}$ values for red, green and blue respectively. In addition the speeds of the red, green and blue curves respectively (defined as the negative log of the relative exposure required to give red, green and blue absorption, respectively, in the neutral column a reflection density of 0.75) were measured.

The following results were obtained:

| FILM UNIT | | R | G | B | SPEED R | SPEED G | SPEED B |
|---|---|---|---|---|---|---|---|
| | | | 55° F. | | | | |
| A | $D_{max}$ | 1.64 | 1.74 | 1.42 | 1.61 | 1.77 | 1.87 |
| | $D_{min}$ | 0.09 | 0.08 | 0.12 | | | |
| | | | 75° F. | | | | |
| A | $D_{max}$ | 1.76 | 1.84 | 1.71 | 1.57 | 1.70 | 1.66 |
| | $D_{min}$ | 0.09 | 0.10 | 0.12 | | | |
| | | | 95° F. | | | | |
| A | $D_{max}$ | 169 | 1.71 | 1.77 | 1.52 | 1.70 | 1.69 |
| | $D_{min}$ | 0.11 | 0.12 | 0.13 | | | |
| | | | 105° F. | | | | |
| A | $D_{max}$ | 1.48 | 1.58 | 1.80 | 1.50 | 1.75 | 1.71 |
| | $D_{min}$ | 0.11 | 0.12 | 0.16 | | | |
| | | | 115° F. | | | | |
| A | $D_{max}$ | 1.30 | 1.32 | 1.46 | 1.47 | 1.82 | 1.88 |
| | $D_{min}$ | 0.12 | 0.13 | 0.19 | | | |

EXAMPLE 2

A control image-receiving element (referred to as IRE-C2) was prepared by coating, in succession, on a polyester film base of 0.067 mm thickness the following layers:

1. an image-receiving layer coated at a coverage of about 300 mgs/ft$^2$ (3229 mgs/m$^2$) of a graft copolymer comprising 4-vinylpyridine (4VP) and vinylbenzyl trimethylammonium chloride (TMQ) grafted onto hydroxyethyl cellulose (HEC) at ratios of HEC/4VP/TMQ of 2.2/2.2/1 and about 5 mgs/ft$^2$ (54 mgs/m$^2$) of 1,4-butanediol-diglycidyl ether; and 2. an overcoat layer coated at a coverage of about 65 mgs/ft$^2$ (700 mgs/m$^2$) comprising 1 part Igepal CO-997 (nonylphenoxyethylene oxide ethanol), 1 part of a 1.0/1.0/0.1/0.1 tetrapolymer of methacrylic acid/diacetone acrylamide/butyl acrylate/styrene, and 0.3 part of polyvinylpyrrolidone.

An image-receiving element of the invention (referred to as IRE-2) was prepared in the same manner as the control, except that layer #2 was an overcoat layer coated at a coverage of about 120 mgs/ft$^2$ (1296 mgs/m$^2$ comprising one part of polyvinyl hydrogen phthalate, potassium salt and one part of a 1/1/0.3 mixture of Igepal CO-997 (nonylphenoxyethylene oxide ethanol), a 1.0/1.0/0.1./0.1 tetrapolymer of methacrylic acid/diacetone acrylamide/butyl acrylate/styrene, and polyvinylpyrrolidone.

Image-receiving elements IRE-C2 and IRE-2 were employed in the following experiment to evaluate their opacification dye clearing efficacy. Photographic film units were prepared using each of the image-receiving elements, the photosensitive element for each film unit being a multicolor photosensitive element prepared by coating the following layers, in succession, onto an opaque subcoated polyethylene terephthalate film base of approximately 0.127 mm thickness:

1. a polymeric acid layer comprising about 24,400 mgs/m$^2$ of the half butyl ester of ethylene maleic anhydride, about 4310 mgs/m$^2$ of polyvinyl butyral and about 89 mgs/m$^2$ of titanium dioxide;

2. a layer of styrene maleic anhydride copolymer coated at a coverage of about 400 mgs/m$^2$;

3. a timing layer comprising a 40/40/18/1.8 tetrapolymer of butyl acrylate/diacetone acrylamide/carbomethoxymethyl acrylate/acrylic acid coated at a coverage of about 2408 mgs/m$^2$;

4. a cyan dye developer layer comprising about 510 mgs/m$^2$ of the cyan dye developer represented by the formula shown in layer #4 of the photosensitive element of EXAMPLE 1, about 413 mgs/m$^2$ of gelatin and about 120 mgs/m$^2$ of 4'-methylphenyl hydroquinone (MPHQ);

5. a layer comprising about 1000 mgs/m$^2$ of titanium dioxide, about 468 mgs/m$^2$ of a 61/29/6/4/0.4 pentapolymer of butylacrylate/diacetone acrylamide/methylacrylic acid/styrene/acrylic acid, about 156 mgs/m$^2$ of gelatin and about 48.8 mgs/m$^2$ of polymethylmethacrylate;

6. a red-sensitive silver iodobromide layer comprising about 1209 mgs/m$^2$ of silver (1.5 microns) and about 877 mgs/m$^2$ of gelatin;

7. an interlayer comprising about 3249 mgs/m$^2$ of the pentapolymer described in layer 5, about 171 mgs/m$^2$ of polyacrylamide and about 134 mgs/m$^2$ of monomethylol dimethyl hydantoin;

8. a magenta dye developer layer comprising about 357 mgs/m$^2$ of magenta dye developer represented by the formula shown in layer #8 of the photosensitive element in EXAMPLE 1, about 222 mgs/m$^2$ of gelatin and about 644 mgs/m$^2$ of 4'-methylphenyl hydroquinone (MPHQ);

9. a green-sensitive silver halide emulsion layer comprising about 880 mgs/m$^2$ of silver 1.8 microns, about 583 mgs/m$^2$ of silver (0.5 microns), about 384 mgs/m$^2$ of gelatin and about 173 mgs/m$^2$ of MPHQ;

10. a layer comprising about 2183 mgs/m$^2$ of the pentapolymer described in layer 5, about 112 mgs/m$^2$ of polyacrylamide and about 18 mgs/m$^2$ of succindialdehyde;

11. a layer comprising about 450 mgs/m$^2$ of scavenger represented by the formula

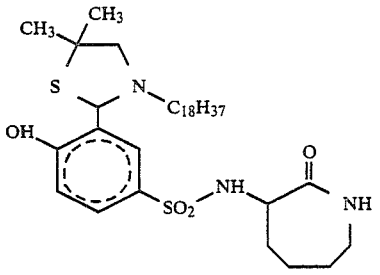

and 17 mgs/m$^2$ of succindialdehyde and 450 mgs/m$^2$ of gelatin;

12. a yellow image dye-providing layer comprising about 1345 mgs/m$^2$ of a yellow image dye-providing material represented by the formula shown in layer #13 of the photosensitive element of EXAMPLE 1 and about 537 mgs/m$^2$ of gelatin;

13. a blue-sensitive silver iodobromide layer comprising about 290 mgs/m$^2$ of silver (1.6 microns), about 500 mgs/m$^2$ of phenyl tertiarybutyl hydroquinone and about 446 mgs/m$^2$ of gelatin; and 14. a gelatin layer coated at a coverage of about 484 mgs/m$^2$.

A photosensitive element as aforedescribed was subjected to a xenon arc photoexposure (to completely expose the emulsion layers thereof and permit evaluation of Dmin sensitometry) and was placed into a superposed relationship with each of the respective IRE-C2 and IRE-2 image-receiving elements. A rupturable container (retaining an aqueous alkaline processing composition, referred to as PC-2) was fixedly mounted at the leading edge of each of the elements, by pressure-sensitive tapes to make a film unit, so that, upon application of compressive force to the container to rupture the marginal seal of the container, the contents thereof would be distributed between the elements placed in a face-to-face relationship, i.e., with their respective supports outermost. The processing composition was distributed between the elements of the film unit by passing the film unit between a pair of pressure-applying rolls having a gap of approximately 0.0024 inch (0.061 mm). The processing composition (PC-2) comprised the ingredients and the amounts stated as follow:

| INGREDIENTS | WEIGHT PERCENT |
|---|---|
| Water | 37.6 |
| Titanium dioxide (rutile) | 47.6 |
| Poly(diacetone acrylamide)oxime | 0.75 |
| Potassium hydroxide (45% aqueous solution) | 5.7 |
| Colloidal silica (30% aqueous dispersion) | 0.24 |
| N—phenylpropyl-α-picolinium bromide (50% solids) | 1.13 |
| 2-methylimidazole | 0.99 |
| Hypoxanthine | 0.99 |
| Calcium chloride, dihydrate | 0.29 |
| Opacification Dye (OD-1) | 0.86 |
| Opacification Dye (OD-2) | 1.97 |
| N—hydroxyethyl-N,N',N',—triscarboxymethyl ethylene diamine | 1.24 |

Each of the film units was evaluated for Dmin performance at predetermined intervals of 10, 20, 30, 40, 50 and 60 seconds after spreading of the PC-2 composition in the manner previously described. The following results were recorded.

| Film Unit With Image-Receiving Element | | Dmin | | |
|---|---|---|---|---|
| | | R | G | B |
| IRE-C2 | 10 sec. | 0.31 | 0.25 | 0.29 |
| | 20 | 0.35 | 0.28 | 0.35 |
| | 30 | 0.39 | 0.32 | 0.39 |
| | 40 | 0.40 | 0.33 | 0.41 |
| | 50 | 0.42 | 0.35 | 0.45 |
| | 60 | 0.43 | 0.36 | 0.46 |
| IRE-2 | 10 sec | 0.18 | 0.16 | 0.17 |
| | 20 | 0.18 | 0.16 | 0.18 |
| | 30 | 0.19 | 0.17 | 0.21 |
| | 40 | 0.20 | 0.18 | 0.22 |
| | 50 | 0.22 | 0.19 | 0.24 |
| | 60 | 0.23 | 0.20 | 0.25 |

As shown in the above Dmin values, the film unit prepared from the image-receiving element of the invention (IRE-2) showed lower Dmin values (greater apparent whiteness) indicative of more efficient clearing of the opacification dyes present in the PC-2 processing composition.

EXAMPLE 3

A control image-receiving element (referred to as IRE-C3) was prepared by coating, in sequence onto a polyester film base of 0.067 mm thickness, the following layers:

1. an image-receiving layer coated at a coverage of about 300 mgs/ft$^2$ (3229 mgs/m$^2$) of a graft copolymer comprising of 4-vinylpyridine (4VP) and vinyl benzyl trimethylammonium chloride (TMQ) grafted onto hydroxyethyl cellulose (HEC) at ratios of HEC/4VP/TMQ of 2.2/2.2/1, about 1 mg/ft$^2$ (10.8 mgs/m$^2$) of 1,4-butanediol-diglycidyl ether, and about 29 mgs/ft$^2$ (312 mgs/m$^2$) of acetic acid; and 2. an overcoat layer coated at a coverage of about 85 mgs/ft$^2$ (915 mgs/m$^2$) comprising 1 part Igepal CO-997 (nonylphenoxyethylene oxide ethanol), 1 part of a 1.0/1.0/0.1/0.1 tetrapolymer of methacrylic acid/diacetone acrylamide/butyl acrylate/stryene, and 0.3 part of polyvinylpyrrolidone.

An image-receiving element of the invention (referred to as IRE-3) was prepared in the same manner as IRE-3C, except that, the overcoat layer (layer #2) was a layer coated at a coverage of about 120 mgs/ft$^2$ (1292 mgs/m$^2$) comprising one part of polyvinyl hydrogen phthalate, potassium salt, and one part of a 1/1/0.35 mixture of Igepal CO-997 (nonylphenoxyethylene oxide ethanol), a 1.0/1.0/0.1/0.1 tetrapolymer of methylacrylic acid/diacetone acrylamide/butyl acrylate/styrene, and polyvinylpyrrolidone, and in addition as a coating aid, a minor amount of surfactant, Zonyl FSN. The pH of the overcoat composition was adjusted to 6.5 prior to coating, using acetic acid (removed by volatilization on drying of the coated element).

Each of image-receiving elements IRE-3 and IRE-C3 was evaluated for haze using a Gardner Pivotable-Sphere Hazemeter (Gardner Laboratory, Inc., Bethesda, Md.), according to the method of ASTM D-1003-6. The haze meter employs an integrating sphere to collect and measure the transmitted light which is passing through a specimen and deviation from an incident beam by forward scattering. Results are reported as percent haze. In addition, photographic evaluation of each of the image-receiving elements was evaluated by forming film units and processing the film units to multicolor integral negative-positive reflection prints. The photosensitive element and the processing composition employed for the evaluation were as follows. Photoexposure of the photosensitive elements was two meter-candle seconds through a standardized wedge target. Pressure-applying rolls having a gap of approximately 0.0028 inch (0.071 mm) were used for processing.

The photosensitive element used for the evaluation was a multicolor photosensitive element prepared by coating the following layers, in succession, onto an opaque subcoated polyethylene terephthalate film base of approximately 0.127 mm thickness:

1. a polymeric acid layer comprising about 24,400 mgs/m$^2$ of the half butyl ester of ethylene maleic anhydride, about 4310 mgs/m$^2$ of polyvinyl butyral and about 89 mgs/m$^2$ of titanium dioxide;

2. a layer of styrene maleic anhydride copolymer coated at a coverage of about 400 mgs/m$^2$;

3. a timing layer comprising a 40/40/18/2 tetrapolymer of butyl acrylate/diacetone acrylamide/carbomethoxymethyl acrylate/acrylic acid coated at a coverage of about 2100 mgs/m$^2$;

4. a cyan dye developer layer comprising about 523 mgs/m$^2$ of the cyan dye developer represented by the formula shown in layer #4 of the photosensitive element of EXAMPLE 1, about 420 mgs/m$^2$ of gelatin and about 103 mgs/m$^2$ of 4'-methylphenyl hydroquinone (MPHQ), and about 57 mgs/m$^2$ of 1,3-bis[1-(4-hydroxyphenyl)-tetrazoyly-(5)-mercapto]-2-propanone oxime;

5. a layer comprising about 800 mgs/m$^2$ of titanium dioxide, about 375 mgs/m$^2$ of a 61/29/6/4/0.4 pentapolymer of butylacrylate/diacetone acrylamide/methylacrylic acid/styrene/acrylic acid, about 125 mgs/m$^2$ of gelatin and about 37.5 mgs/m$^2$ of polymethylmethacrylate;

6. a red-sensitive silver iodobromide layer comprising about 1300 mgs/m$^2$ of silver (1.5 microns) and about 877 mgs/m$^2$ of gelatin;

7. an interlayer comprising about 3249 mgs/m$^2$ of the pentapolymer described in layer 5, about 171 mgs/m$^2$ of polyacrylamide and about 171 mgs/m$^2$ of monomethylol dimethyl hydantoin;

8. a magenta dye developer layer comprising about 433 mgs/m$^2$ of magenta dye developer represented by the formula shown in layer #8 of the photosensitive element in EXAMPLE 1, about 270 mgs/m$^2$ of gelatin and about 488 mgs/m$^2$ of 2-phenylbenzimidazole and 49 mgs/m$^2$ of 1,3-bis[1-4-hydroxyphenyl)-tetrazolyl-(5)-mercapto]-2-propanone oxime;

9. a layer comprising about 355 mgs/m$^2$ of Dow 620 (carboxylated styrene-butadiene copolymer) latex and about 183 mgs/m$^2$ of gelatin;

10. a green-sensitive silver halide emulsion layer comprising about 1176 mgs/m$^2$ of silver (1.8 microns), about 295 mgs/m$^2$ of silver (1.1 microns), about 566 mgs/m$^2$ of gelatin and about 260 mgs/m$^2$ of MPHQ;

11. a layer comprising about 2114 mgs/m$^2$ of the pentapolymer described in layer 5, about 136 mgs/m$^2$ of polyacrylamide and about 607 mgs/m$^2$ scavenger represented by the formula

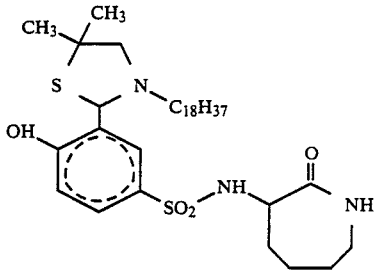

and 18 mgs/m$^2$ of succindialdehyde;

12. a layer comprising about 499 mgs/m$^2$ of benzidine yellow dye and about 150 mgs/m of gelatin;

13. a yellow image dye-providing layer comprising about 977 mgs/m$^2$ of a yellow image dye-providing material represented by the formula shown in layer #13 of the photosensitive element of EXAMPLE 1, and about 390 mgs/m$^2$ of gelatin;

14. a layer comprising abut 514 mgs/m$^2$ phenyl tertiarybutyl hydroquinone and about 283 mgs/m$^2$ of gelatin;

15. a blue-sensitive silver iodobromide layer comprising about 232 mgs/m$^2$ of silver (1.6 microns), about 58 mgs/m$^2$ of silver (1.3 microns) and about 145 mgs/m$^2$ of gelatin; and 16. a gelatin layer coated at a coverage of about 800 mgs/m$^2$.

The aqueous alkaline processing composition employed for processing comprised the following ingredients in the stated amounts:

| INGREDIENTS | WEIGHT PERCENT |
|---|---|
| Water | 40.31 |
| Titanium dioxide | 48.04 |
| Colloidal silica (30% aqueous dispersion) | 0.23 |
| Potassium hydroxide (45% aqueous solution) | 4.34 |
| N—phenethyl-α-picolinium bromide (50% solids) | 1.44 |
| 6-methyluracil | 0.41 |
| Oximated polydiacetone acrylamide | 0.77 |
| Hypoxanthine | 0.46 |
| 2-methylamidazole | 0.49 |
| Zonyl FSN (40% solids) | 0.20 |
| 1-(4-hydroxyphenyl)-1H—tetrazole-5-thiol | 0.01 |
| Carboxylated styrene-butadiene copolymer* | 1.48 |
| Opacification Dye (OD-1) | 0.44 |
| Opacification Dye (OD-2) | 1.49 |

*added as Dow 620 latex, a 50% solids carboxylated 67/33 styrene-butadiene latex of Dow Chemical Company.

Results of the aforedescribed haze and photographic evaluations were as follows:

| Film Unit Using Image-Receiving | Dmax | | | Dmin | | | Haze |
|---|---|---|---|---|---|---|---|
| Element: | R | G | B | R | G | B | (%) |
| IRE-C3 | 1.21 | 1.90 | 1.69 | 0.08 | 0.09 | 0.09 | 32.4 |
| IRE-3 | 1.66 | 2.11 | 1.76 | 0.07 | 0.08 | 0.09 | 5.52 |

Inspection of the photographic results shows improvements, i.e., higher Dmax values and lower Dmin values, using the image-receiving element of the invention (IRE-3) relative to the control element (IREC-3). In addition, a substantially lower level of haze can be seen for image-receiving element IRE-3 compared to the control.

EXAMPLE 4

An image-receiving element of the invention was prepared by simultaneously coating the image-receiving and overcoat layers, using a slot coater having a pair of slots for depositing the superposed layers onto the polyester film base material having a thickness of about 0.067 mm. The image-receiving element (referred to as IRE-4) had the following layers, in order, on the polyester film base material:

1. an image-receiving layer coated at a coverage of about 300 mgs/ft$^2$ (3229 mgs/m$^2$) of a graft copolymer comprised of 4-vinylpyridine (4VP) and vinyl benzyl trimethylammonium chloride (TMQ) grafted onto hydroxyethyl cellulose (HEC) at ratios of HEC/4VP/TMQ of 2.2/2.2/1, about 1 mg/ft$^2$ (10.8 mgs/m$^2$) of 1,4-butanediol-diglycidyl ether, and about 29 mgs/ft$^2$ (312 mgs/m$^2$) of acetic acid; and 2. an overcoat layer coated at a coverage of about 90 mgs/ft$^2$ (969 mgs/m$^2$) comprising one part polyvinyl hydrogen phthalate, potassium salt and three parts of a 1/1/0.3 mixture of Igepal CO-997 (nonylphenoxyethylene oxide ethanol), a 1.0/1.0/0.1/0.1 tetrapolymer of methacrylic acid/diacetone acrylamide/butyl acrylate/styrene and polyvinylpyrrolidone.

The image-receiving element was evaluated for haze level using the aforedescribed Gardner instrument and ASTM method and showed a level of haze of 1.57%. The element was combine with a photosensitive element and photographically imaged and processed in the manner described in Example 3. Similar results were obtained in that an integral photographic laminate having good color quality and balance was obtained.

What is claimed is:

1. A method for preparing an image-receiving element for use in a diffusion transfer process, which comprises simultaneously depositing as superposed layers onto a transparent support, an image-receiving layer containing a polymeric mordant having quaternary ammonium mordanting moieties for mordanting a diffusible image-providing material, and an overcoat layer, said overcoat layer comprisinig a polyoxyalkylene decolorizing agent hydrogen bonded with at least one other polymer and a salt of polyvinyl hydrogen phthalate.

2. A method of claim 1 wherein said salt of polyvinyl hydrogen phthalate is a sodium, potassium, lithium or ammonium salt.

3. The method of claim 1 wherein said polyoxyalkylene decolorizing agent is a wax-like polyoxyethylene polymer.

4. The method of claim 3 wherein said polyoxyethylene polymer is nonylphenoxyethylene oxide ethanol.

5. The method of claim 1 wherein said other polymer hydrogen bonded with said decolorizing agent is a copolymer of diacetone acrylamide and methacrylic acid.

6. The method of claim 5 wherein said copolymer is a 1/1/0.1/0.1 tetrapolymer of methacrylic acid, diacetone acrylamide, butyl acrylate and styrene.

7. The method of claim 6 wherein said overcoat layer additionally contains polyvinyl pyrrolidone.

8. The method of claim 1 wherein said overcoat layer is deposited as an aqueous layer superposed on said image-receiving layer, said aqueous layer having a solids content of from 2% to 4% by weight.

* * * * *